US009159263B2

(12) United States Patent
Choi et al.

(10) Patent No.: US 9,159,263 B2
(45) Date of Patent: Oct. 13, 2015

(54) PIXEL WITH ENHANCED LUMINANCE NON-UNIFORMITY, A DISPLAY DEVICE COMPRISING THE PIXEL AND DRIVING METHOD OF THE DISPLAY DEVICE

(71) Applicant: Samsung Display Co., Ltd., Yongin, Gyeonggi-Do (KR)

(72) Inventors: Yang-Hwa Choi, Yongin (KR); Cheol-Min Kim, Yongin (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 205 days.

(21) Appl. No.: 13/901,064

(22) Filed: May 23, 2013

(65) Prior Publication Data

US 2014/0146028 A1 May 29, 2014

(30) Foreign Application Priority Data

Nov. 29, 2012 (KR) ..... 10-2012-0137231

(51) Int. Cl.
*G09G 3/32* (2006.01)

(52) U.S. Cl.
CPC ..... *G09G 3/3225* (2013.01); *G09G 2300/0852* (2013.01); *G09G 2310/0248* (2013.01); *G09G 2320/045* (2013.01)

(58) Field of Classification Search
CPC ..... G09G 2320/0248; G09G 2310/0245–2310/0251; G09G 2300/0852; G09G 2320/045; G09G 3/3225
See application file for complete search history.

(56) References Cited

U.S. PATENT DOCUMENTS

| | | | | |
|---|---|---|---|---|
| 7,633,478 | B2 * | 12/2009 | Morita | 345/95 |
| 2006/0158409 | A1 * | 7/2006 | Shi et al. | 345/87 |
| 2012/0235973 | A1 * | 9/2012 | Yoo | 345/211 |
| 2013/0249883 | A1 * | 9/2013 | Hwang | 345/212 |

FOREIGN PATENT DOCUMENTS

| | | |
|---|---|---|
| KR | 1020040020461 | 3/2004 |
| KR | 1020080003715 | 1/2008 |
| KR | 1020090116402 | 11/2009 |

* cited by examiner

*Primary Examiner* — Larry Sternbane
(74) *Attorney, Agent, or Firm* — Robert E. Bushnell, Esq.

(57) ABSTRACT

A pixel, a display device including the same, and a driving method thereof. The display device includes: a data driver transmitting data signals; a scan driver generating and transmitting scan signals; a display panel including pixels, each emitting light with a driving current according to the data signals; a compensation signal unit generating and transmitting a compensation control signal for controlling simultaneous transmission of a predetermined bias voltage to each of the pixels before a data voltage according to the data signals is applied to each of the pixels; a power controller controlling voltage levels of the first power source voltage and the second power source voltage and supplying the level-controlled first and second power source voltages; and a timing controller generating the data signals by processing an external image signal and generating a plurality of driving control signals.

22 Claims, 6 Drawing Sheets

PIXEL WITH ENHANCED LUMINANCE NON-UNIFORMITY, A DISPLAY DEVICE COMPRISING THE PIXEL AND DRIVING METHOD OF THE DISPLAY DEVICE

CLAIM OF PRIORITY

This application makes reference to, incorporates the same herein, and claims all benefits accruing under 35 U.S.C. §119 from an application for PIXEL, DISPLAY DEVICE COMPRISING THE PIXEL AND DRIVING METHOD OF THE DISPLAY DEVICE earlier filed in the Korean Intellectual Property Office on 29 Nov. 2012 and there duly assigned Serial No. 10-2012-0137231.

BACKGROUND OF THE INVENTION

1. Field of the Invention

The present invention relates to a display device and a driving method thereof. More particularly, the present invention relates to a display device including an organic light emitting diode (OLED) and a pixel that is digitally driven, and a driving method thereof.

2. Description of the Related Art

Recently, a display panel has increased in size and reduced in weight, and a stable driving method of a frame has been developed in order to display an accurate and clear image with high-integration and high-precision of a display device which is required to implement a 3D stereoscopic image.

An analog-type driving method of a conventional display device increases the number of circuit elements in a pixel so that it cannot be applied to a large-sized panel, and causes problems in high-resolution display panel, particularly, FULL HD panel. A conventional pixel circuit is formed of 7 to 8 transistors and 2 to 3 capacitors, and this becomes a difficulty in layout design and manufacturing of the display panel.

In order to solve such a problem, a digital driving method replaces the analog driving method and high integration and high resolution can be realized by reducing the number of circuits in a pixel. In particular, in the pixel employing the digital driving method can be formed of 2 to 3 transistors and 1 capacitor so that the difficulty in layout design and manufacturing of the display panel can be solved.

However, a driving transistor transmitting a driving current according to a data signal is operated in a linear area in the digitally driven pixel, and thus luminance is not uniform in the entire panel depending on a material of an organic light emitting diode and a distribution characteristic such as processing. Thus, a failure such as long range uniformity (LRU) or a short range uniformity (SRU) occurs in the display panel, thereby causing deterioration of the display device.

Accordingly, development and research for a pixel structure having high integration and high resolution adaptability in the digital driving method while having a screen display characteristic of the conventional analog driving method, and a display device including the same and a driving method thereof are required.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a pixel circuit corresponding to a digital driving method to provide a display device appropriate to high integration and high resolution while controlling a driving transistor of a pixel of the display device to be operated in a saturation area, thereby increasing display quality that equals to display quality of an analog driving method.

In addition, the present invention simplifies the complex pixel circuit by reducing the number of elements so that a layout of the pixel can be simply designed, and provides a pixel structure that does not sensitively respond characteristic deterioration of an organic light emitting element so that durability and productivity of the display device can be improved.

A display device according to an exemplary embodiment of the present invention includes: a data driver transmitting a plurality of data signals; a scan driver generating and transmitting a plurality of scan signals; a display panel including a plurality of pixels, each emitting light with a driving current according to the plurality of data signals; a compensation signal unit generating and transmitting a compensation control signal for controlling simultaneous transmission of a predetermined bias voltage to each of the plurality of pixels before a data voltage according to the plurality of data signals is applied to each of the plurality of pixels; a power controller controlling voltage levels of the first power source voltage and the second power source voltage and supplying the level-controlled first and second power source voltages; and a timing controller generating the plurality of data signals by processing an external image signal and generating a plurality of driving control signals that respective control driving of the data driver, the scan driver, the compensation signal unit, and the power controller.

The predetermined bias voltage is set as a white voltage that displays the maximum luminance along the plurality of data signals.

The display panel may be formed of a first pixel area including a plurality of first pixels among the plurality of pixels and a second pixel area including a plurality of second pixels that are the rest of pixels, excluding the first pixels from the plurality of pixels. In this case, the compensation signal unit may be connected to a first compensation control line connected to the plurality of first pixels include in the first pixel area and a second compensation control line connected to the plurality of second pixels included in the second pixel area, and the compensation signal unit may generate and transmit a first compensation control signal and a second compensation control signal controlling application of the bias voltage respectively through the first compensation control line and the second compensation control line.

The plurality of first pixels included in the first pixel area and the plurality of second pixels included in the second pixel area respectively have an iterative alignment of a unit of a first color pixel, a second color pixel, a third color pixel, and the second color pixel.

The compensation signal unit transmits the first compensation control signal and the second compensation control signal before a plurality of data signals are transmitted to the plurality of pixels included in the display panel.

The bias voltage may be applied to each of the plurality of pixels through the plurality of data lines connected to the data driver and each of the plurality of pixel, but the present invention is not limited thereto.

Each of the plurality of pixels may include a switching element of which switching operation is controlled by the compensation control signal, and the bias voltage may be applied to the turn-on switching element corresponding to the compensation control signal.

Each of the plurality of pixels receives the bias voltage through a source electrode of a driving transistor thereof corresponding to the compensation control signal.

The power controller supplies the first power source voltage as a predetermined high-level voltage during one frame, and supplies the second power source voltage as a predetermined high-level voltage for a compensation period during which the compensation control signal is transmitted in one frame.

A pixel according to another exemplar embodiment of the present invention includes: an organic light emitting diode; a driving transistor electrically connected to a first power source voltage supply line and supplying a driving current to the organic light emitting diode; a switching transistor connected to the corresponding scan line among a plurality of scan lines transmitting a plurality of scan signals to transmit a data voltage according to the corresponding data signal among a plurality of data signal to a gate electrode of the driving transistor according to the corresponding scan signal; a compensation transistor connected between the first power source voltage supply line and the driving transistor to receive a predetermined bias voltage during a compensation period in one frame; a control transistor connected to a data line transmitting the data voltage to transmit the bias voltage to a gate electrode of the compensation transistor through the data line in response to a compensation control signal during the compensation period; a compensation capacitor connected to the gate electrode of the compensation transistor; and a storage capacitor connected to the gate electrode of the driving transistor.

The control transistor includes a gate electrode receiving the compensation control signal, a source electrode connected to the data line to receive the bias voltage during the compensation period, and a drain electrode connected to the gate electrode of the compensation transistor.

The control transistors included in the respective pixel areas receive compensation control signals respectively transmitted during different periods in the compensation period through compensation control lines connected with gate electrodes thereof.

According to another exemplary embodiment of the present invention provides a method for driving a display device including a plurality of pixels, each including an organic light emitting diode, a driving transistor connected to a first power source voltage supply line to supply a driving current to the organic light emitting diode, a compensation transistor provided between the first power source voltage supply line and the driving transistor to receive a predetermined bias voltage for the driving transistor to be operated in a saturation area, a compensation capacitor connected to a gate electrode of the compensation transistor, and a storage capacitor connected to a gate electrode of the driving transistor. In further detail, The method includes: a compensation step for simultaneously storing the bias voltage in the compensation capacitor of the respective pixels; a scanning and data writing step for the plurality of pixels to sequentially store data voltages according to the corresponding data signals among a plurality of data signals of one frame for each pixel line to the storage capacitors thereof in response to the corresponding scan signals among a plurality of scan signals of the frame; and a light emission step for the organic light emitting diode to emit light according to the driving current corresponding to the data voltage applied to the gate electrode of the driving transistor.

Accordingly to the present invention, a simple pixel circuit structure corresponding to a digital driving method is suggested to provide a display device that is appropriate to high integration and high resolution. Furthermore, the present invention enables a driving transistor of the pixel circuit to be operated in saturation to thereby display quality with improved reliability and uniformity by preventing luminance from being changed in a display panel due to characteristic deterioration of the organic light emitting element.

In addition, the number of elements is reduced in a complicated pixel circuit so that layout design of the circuit can be simplified and accordingly productivity of the display device can be improved.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
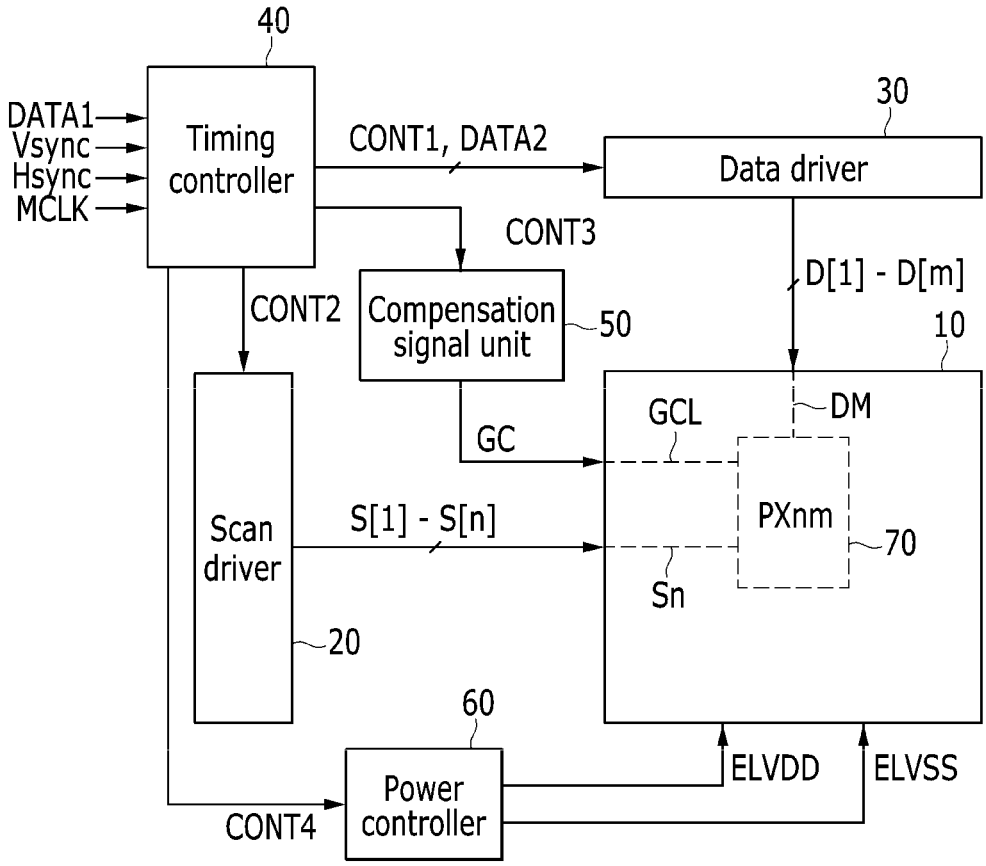
FIG. 1 is a block diagram of a display device according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

In order to clarify the present invention, parts that are not connected with the description will be omitted, and the same elements or equivalents are referred to by the same reference numerals throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

FIG. 1 is a block diagram of a display device according to an exemplary embodiment of the present invention.

As shown in FIG. 1, the display device includes a display panel 10, a scan driver 20, a data driver 30, a timing controller 40, a compensation signal unit 50, and a power controller 60.

The display panel 10 includes a plurality of pixels 70, each connected to a corresponding scan line (e.g., Sn in FIG. 1) among a plurality of scan lines S1-Sn (not shown), the corresponding data line (e.g., Dm in FIG. 1) among a plurality of data lines D1-Dm (not shown), and a compensation control line GCL. In addition, although it is not illustrated in FIG. 1, each of the plurality of pixels is connected to a first voltage line receiving a first power source voltage ELVDD therethrough and a second voltage line receiving a second power source voltage ELVSS therethrough.

The corresponding scan signals S[1]-S[n] among the plurality of scan signals are transmitted through the plurality of scan lines S1-Sn, and the corresponding data signals among the plurality of data signals D[1]-D[m] are transmitted through the plurality of data lines D1-Dm. In addition, a compensation control signal GC that controls operation of a driving transistor in each pixel in a saturation area through the compensation control line GCL.

FIG. 1 illustrates a pixel having a general pixel alignment structure (e.g., an RGB alignment structure), and therefore the same compensation control signal GC is transmitted to the entire pixels of the display panel through the corresponding compensation control lines GCL. However, if the pixel has a pixel alignment structure (e.g., an RGBG PenTile structure) as in the exemplary embodiment of FIG. 4, the pixel of the display panel 10 can receive the corresponding area-specific compensation control signal among a plurality of area-specific compensation control signals respectively having different driving timings through area-specific compensation control lines determined corresponding to pixel areas.

Meanwhile, the plurality of data signals D[1]-D[m] are image data signals corresponding to an image data signal DATA2 generated through an image processing process such as luminance correction with respect to an external image signal DATA1, and transmitted to the respective pixels of the display panel 10.

In addition, the plurality of scan signals S[1]-S[n] activates each of the plurality of pixels included in the display panel 10 to display an image according to the corresponding data signal.

Each of the plurality of pixels is activated according to the corresponding scan signal and displays an image by emitting light with a driving current according to the corresponding data signal.

In addition, the compensation control signal GC is simultaneously transmitted to each of the plurality of pixels included in the display panel 10 for controlling transmission of a predetermined bias voltage for operation in a saturation area before each pixel to generate a driving current for displaying an image according to a data signal.

Meanwhile, the scan driver 20 generates a plurality of scan signals S[1] to S[n] according to a scan signal CONT2 and transmits the generated scan signals to the plurality of scan signals connected to the display panel. The scan control signal CONT2 controls sequential transmission of scan signals corresponding to the respective pixel lines to the respective pixels included in the display panel during a scan period.

The data driver 30 transmits an image data signal DATA2 corresponding to an external image signal DATA1 to each of the plurality of pixels of the display panel through the corresponding data line according to a data control signal CONT1. The data control signal CONT1 controls sequential transmission of the corresponding data signals D[1] to D[m] to the respective pixels activated by the scan signals during a scan signal of one frame among image data signal DATA2. Then, each of the plurality of pixels writes data by storing a data voltage according to the corresponding data signal among the data signals D[1] to D[m].

According to the exemplary embodiment of the present invention, the data driver 30 simultaneously transmits a predetermined bias voltage through the data line to each of the plurality of pixels before transmission of a data voltage according to an image data signal according to the control of the data control signal CONT1. The bias voltage is not restrictive, but may be a voltage value for light emission with highest luminance with respect to a color realized by an organic light emitting element.

The compensation signal unit 50 generates and transmits a compensation control signal GC to the plurality of pixels of the display panel according to a compensation driving control signal CONT3. In addition, in case of an exemplary embodiment of a driving method that is changed according to a pixel area, the compensation signal unit 50 may generate a plurality of compensation control signals for each pixel using the compensation driving control signal CONT3. In addition, according to the compensation driving control signal CONT3, compensation control signals, each having a different driving waveform corresponding to each pixel area can be transmitted to a plurality of pixels included in each pixel area.

In this case, the compensation control signal GC is transmitted to the entire pixels of the display panel for a driving transistor of each pixel to be operated in a saturation area before transmission of the plurality of scan signals S[1] to S[n] to the respective pixels 70 of the display panel 10.

The power controller 60 controls voltage levels of the first power source voltage ELVDD and the second power source voltage ELVSS that drive the respective pixels and supplies the first power source voltage ELVDD and the second power source voltage ELVSS through a first voltage line and a second voltage line connected to the respective pixels of the display panel 10 according to a power control signal CONT4.

According to the driving method of the present invention, the second power source voltage ELVSS may be controlled to be a predetermined high-level voltage and a predetermined low-level voltage depending on a driving period. However, according to the driving method of the present invention, the first power source voltage ELVDD may be fixed to a predetermined high-level voltage.

The power control signal CONT4 controls the power controller 60 to control voltage levels of the first power source voltage ELVDD and the second power source voltage ELVSS corresponding to the respective driving process and transmit the level-controlled first and second power source voltages ELVDD and ELVSS to the entire pixels. In further detail, the driving method according to the exemplary embodiment of the present invention includes a compensation process for applying a predetermined bias voltage for a driving transistor to be operated in a saturation area through a data line of each pixel, a scan and data signal writing process for instantaneous activation of each pixel, and a light emission process for each pixel displays an image with a driving current according to a data signal applied thereto.

The power controller 60 determines the voltage levels of the first power source voltage ELVDD and the second power source voltage ELVSS corresponding to the respective driving processes and supplies the first and second power source voltages ELVDD and ELVSS to the corresponding voltage line.

The timing controller 40 generates the corresponding image data signal DATA2 from the external image signal DATA1. In detail, the timing controller 40 classifies the image signal DATA1 into a frame unit according to a vertical synchronization signal Vsync and classifies the image signal DATA1 into a pixel line (scan line) unit according to a horizontal synchronization signal Hsync and processes the external image signal DATA1 to generate an image data signal DATA2. The image data signal DATA2 is transmitted to the data driver 30 together with the data control signal CONT1.

The image signal DATA1 and the vertical synchronization signal Vsync, the horizontal synchronization signal Hsync, and a synchronization signal of the main clock signal MCLK are processed from the external input signal.

The image signal DATA1 is a signal processed to the image signal corresponding to the corresponding frame by classifying the external input signal into each frame unit. In some cases, the image signal DATA1 may include image signals corresponding to a left-eye view point and a right-eye view point for implementing the 3D stereoscopic image. In the case of the exemplary embodiment, the timing controller 40 arranges an image data signal of a first view point (left eye or right eye) and an image data signal of a second view point (right eye or left eye) from the external input signal according to vertical synchronization and horizontal synchronization to generate image data signals.

As described above, according to the exemplary embodiment of the present invention, one frame includes a compensation process, a scanning and data writing process, and a light emission process and the scanning process and the light emission process mostly occupies one frame (60 Hz), and therefore, the vertical synchronization signal Vsync can be transmitted every scanning and light emission times that almost occupies one frame.

In addition, the horizontal synchronization signal Hsync has a frequency determined according to a period during which a scanning process is performed in one frame period, and the frequency may be set to a frequency that activates each pixel line in the display panel.

The main clock signal MCLK may be one of a clock signal having a basic frequency included in the external input signal and a clock signal generated through an appropriate preprocessing.

In addition, the timing controller 40 generates the plurality of driving control signals for controlling functions and operation of the respective drivers of the display device and transmits the generated driving control signals to the corresponding drivers. In further detail, the data driving control signal CONT1 can be generated and then transmitted to the data driver 30, the scan driving control signal CONT2 can be generated and then transmitted to the scan driver 20, the compensation driving control signal CONT3 can be generated and then transmitted to the compensation signal unit 50, and the power control signal CONT4 can be generated and then transmitted to the power controller 60.

Figure 2:
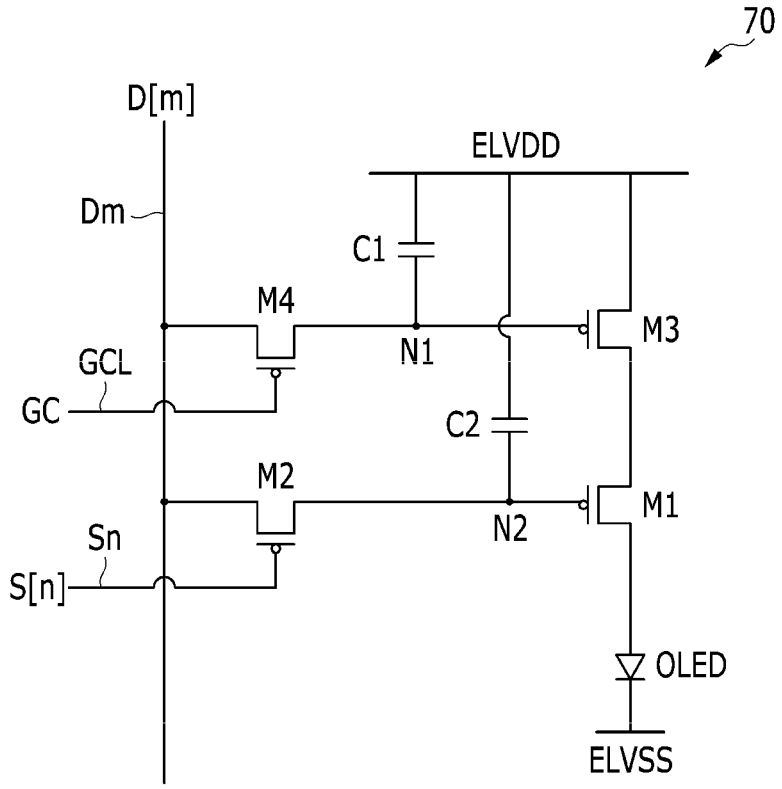
FIG. 2 is a circuit diagram of a pixel according to the exemplary embodiment of the present invention.

FIG. 2 shows a circuit diagram of each of the pixels 70 according to the exemplary embodiment of the present invention. In particular, FIG. 2 illustrates a pixel PXnm corresponding to the n-th pixel line and the m-th pixel column among the plurality of pixels included in the display panel of FIG. 1.

Thus, the pixel 70 illustrated in FIG. 2 is connected to the n-th scan line Sn connected to the n-th pixel line and the m-th data line Dm connected to the m-th pixel column. In addition, when the plurality of pixels included in the display panel 10 of FIG. 1 according to the exemplary embodiment of the present invention has a general digital driving RGB alignment, the same compensation control signal GC is transmitted to the entire pixels, and therefore the entire pixels are commonly connected to the compensation control line GCL that transmits the compensation control signal GC. In addition, the pixel 70 has a structure in which voltage lines respectively transmitting the first power source voltage ELVDD and the second power source voltage ELVSS are connected to lateral ends where a driving transistor M1, a compensation transistor M3, and an organic light emitting diode OLED are connected in series in the pixel. In further detail, the first power source voltage ELVDD that is required for operation of the pixel is supplied through a first voltage line (not shown), and the second power source voltage ELVSS is supplied through a second voltage line (not shown) connected to a cathode of the organic light emitting diode OLED.

The pixel 70 of FIG. 2 includes four transistors M1, M2, M3, and M4, a compensation capacitor C1, a storage capacitor C2, and the organic light emitting diode OLED.

The four transistors M1, M2, M3, and M4 illustrated in FIG. 2 are P-channel type transistors. However, the present invention is not limited thereto, and a channel type of each transistor is determined according to a level of a signal input to a gate electrode of each transistor and an operation state of each transistor according to the signal level.

The first transistor M1 includes a source electrode connected to the first power source voltage ELVDD, a drain electrode connected to an anode of the organic light emitting diode OLED, and a gate electrode connected to a second node N2. In particular, the source electrode is connected to a drain electrode of the third transistor M3, and connected to a supply voltage line of the first power source voltage ELVDD, interposing the third transistor M3 therebetween. When the pixel is activated during the scan period, the first transistor M1 receives a data voltage according to an image data signal through the gate electrode thereof and generates the corresponding driving current, and then an image is displayed by transmitting the driving current to the organic light emitting diode OLED.

The second transistor M2 includes a source electrode connected to the m-th data line Dm and receiving a data voltage according to an image data signal D[m] during the scan period among the driving process according to the exemplary embodiment of the present invention through the data line, a drain electrode connected to the second node N2, and a gate electrode connected to the n-th scan line Sn and receiving the n-th scan signal S[n]. The second transistor M2 is turned on according to the corresponding scan signal (S[n] in the pixel of FIG. 2) during the scan period and transmits a data voltage according to the image data signal D[m] to the second node N2 to which the gate electrode of the first transistor M1 is connected through the data line.

The third transistor M3 includes a source electrode connected to the first power source voltage ELVDD, a drain electrode connected to the source electrode of the first transistor M1, and a gate electrode connected to a first node N1. The third transistor M3 is a compensation transistor that can enhance luminance non-uniformity according to a distribution characteristic of the driving transistor of each pixel and prevent luminance according to an image data signal from being changed due to deterioration characteristic of the organic light emitting diode OLED. Thus, according to the driving process of the present invention, the compensation period is set before the scanning and data writing periods, and a bias voltage is applied to the gate electrode of the third transistor M3 during the compensation period. The bias voltage is a voltage that corresponds to the maximum drain-source voltage among voltage values that enable the transistors of the pixel to be driven in the saturation area, and corresponds to white luminance among a data voltage according to an image data signal.

The fourth transistor M4 includes a source electrode connected to the m-th data line Dm and receiving a predetermined voltage (i.e., bias voltage) during the compensation period among the driving period according to the exemplary embodiment of the present invention through the data line, a drain electrode connected to the first node N1, and a gate electrode connected to the compensation control line GCL through which the compensation control signal GC is transmitted. The fourth transistor M4 transmits a predetermined bias voltage applied through the data line Dm to the first node N1 to which the gate electrode of the third transistor M3, which is the compensation transistor, is connected during the compensation period. In this case, driving of the third transistor M3 by transmitting the bias voltage is determined by the compensation control signal GC applied to the gate electrode of the fourth transistor M4.

The compensation capacitor C1 includes a first electrode connected to the first node N1 and a second electrode connected to the supply voltage line of the first power source voltage ELVDD. The compensation capacitor C1 stores and maintains a voltage value according to a difference between voltages respectively applied to the first and second electrodes. Thus, since the first electrode of the compensation capacitor C1 is commonly connected to the first node N1 with the gate electrode of the third transistor M3, the compensation capacitor C1 maintains the bias voltage transmitted to the first node during the compensation period among the driving period of the present invention during one frame.

The storage capacitor C2 includes a first electrode connected to the second node N2 and a second electrode connected to the supply voltage line of the first power source voltage ELVDD. Since the first electrode of the storage capacitor C2 is commonly connected to the second node N2 with the gate electrode of the first transistor M1, the storage capacitor C2 stores and maintains a data voltage according to an image data signal transmitted to the second node N2 during the scan period among the driving period of the present invention.

Figure 3:
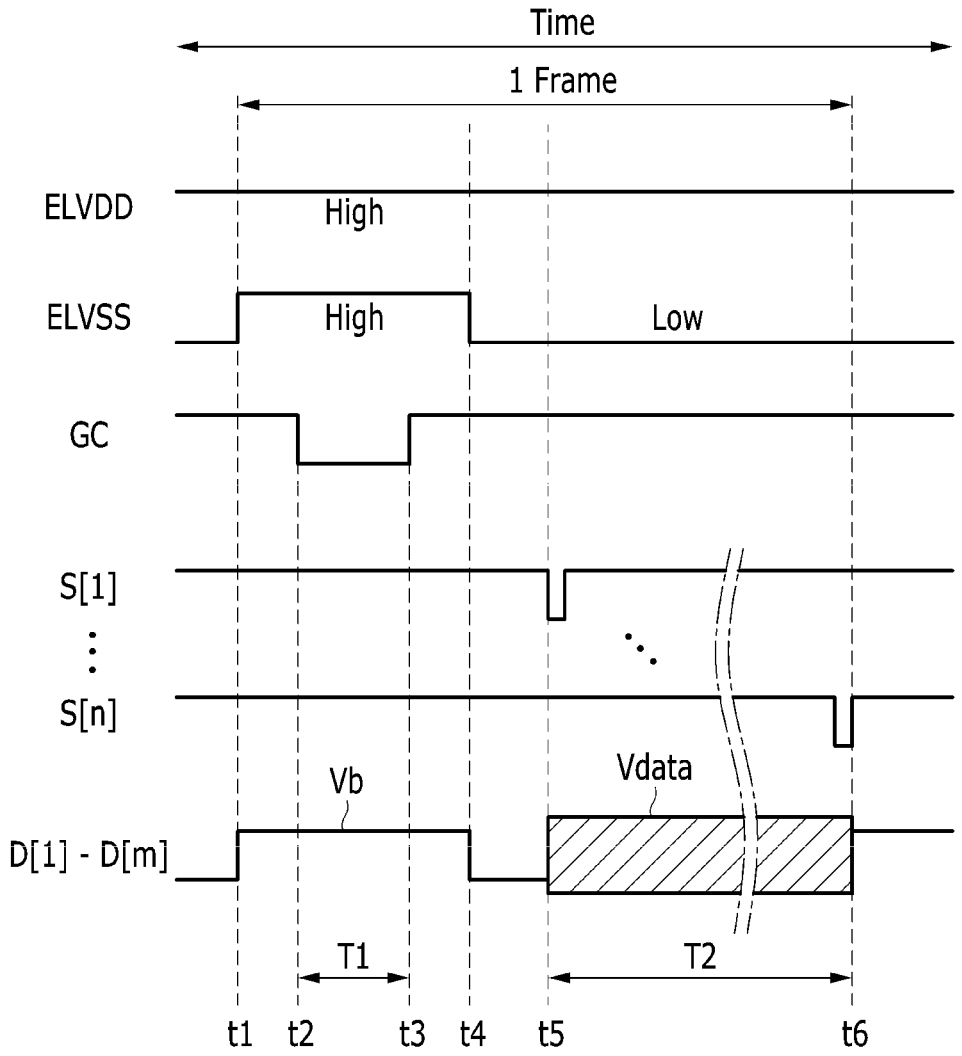
FIG. 3 is a timing diagram of a driving waveform of the pixel of FIG. 2.

FIG. 3 is a timing diagram of a driving waveform of the pixel 70 illustrate in FIGS. 1 and 2. Referring to FIG. 3, operation of the pixel 70 according to each period of the driving process according to the exemplary embodiment of the present invention during one frame (1 Frame) among a plurality of frames will be described.

The driving waveform of FIG. 3 illustrates the minimum driving process that is necessary for description of operation according to the pixel structure of FIG. 2, and therefore a circuit structure of the pixel may be added or changed according to various exemplary embodiments of the present invention, and thus a driving process may be added accordingly. For example, a period for performing a pixel reset process or a process for compensating a threshold voltage of a driving transistor may further be included before or after a compensation period T1 or a scan period T2 of FIG. 3.

Referring to FIG. 3, the second power source voltage ELVSS applied as a low-level voltage is changed to a high-level voltage at a time t1. The second power source voltage ELVSS is applied as the high-level voltage until a time t4. Meanwhile, the first power source voltage is set to a predetermined high-level voltage and then applied and maintained with the predetermined voltage level during one frame.

Thus, a potential of the cathode of the organic light emitting diode OLED is increased by the second power source voltage ELVSS applied as the high-level voltage during a period from the time t1 to the time t4 so that no current path is formed toward a terminal of the second power source voltage ELVSS.

Next, the compensation control signal GC is changed from a high-level pulse voltage to a low-level pulse voltage and then applied at a time t2. The fourth transistor M4 is turned on by receiving the low-level compensation control signal GC through the gate electrode thereof and receives bias voltage Vb through the corresponding data line Dm to which the source electrode thereof is connected. In this case, the bias voltage Vb is commonly applied to the corresponding data lines of all the pixels. The bias voltage Vb is a voltage than enables light emission with white luminance within a data voltage range of an image data signal.

The bias voltage Vb is transmitted to node N1 and to the gate electrode of the third transistor M3 via the fourth transistor M4 of the pixel through the corresponding data line Dm until the compensation control signal GC is changed to the high-level pulse voltage at a time t3. Thus, the compensation capacitor C1 connected to node N1 and to the gate electrode of the third transistor M3 charges a voltage corresponding to the bias voltage and maintains the charged voltage during one frame. A period from the time t2 to the time t3 is a compensation period T1.

The bias voltage Vb is determined according to the peak voltage of a drain-source voltage Vds of the third transistor M3 of the pixel at once for the third transistor M3 to be operated in the saturation area. For all the pixels, the corresponding bias voltage Vb is simultaneously applied to all the pixels during the compensation period T1.

The compensation control signal GC is increased to high level at the time t3 at which time the compensation period T1 is terminated, and accordingly, the fourth transistor M4 is turned off and the bias voltage Vb is not further transmitted to the third transistor M3 through the data line.

Next, the first scan signal S[1] is transmitted with a low-level pulse through the first scan line connected to the first pixel line at a time t5. Thus, the plurality of scan signals S[1] to S[n] are sequentially transmitted with the low-level pulse through the plurality of scan lines connected along the pixel line from the time t5 to a time t6.

The period from the time t5 to the time t6 is a scan period T2, and thus switching transistors (the second transistors M2 of FIG. 2) of the respective pixels that received the corresponding scan signals among the plurality of pixels included in the display panel 10 are sequentially turned on during the scan period T2. That is, in case of the pixel illustrated in FIG. 2, the second transistor M2 is turned on in response to the n-th scan signal S[n], and the turned-on second transistor M2 receives a data voltage according to the corresponding data signal D[m] among image data signals of the corresponding frame to the second node N2 through the corresponding data line. Since the gate electrode of the first transistor M1 and the storage capacitor C2 are connected to the second node N2, the storage capacitor C2 stores and maintains the corresponding voltage Vdata according to the image data signal of each frame during a predetermined period of time. In addition, the first transistor M1 generates a driving current according to the data voltage applied to the gate electrode thereof and transmits the driving current to the organic light emitting diode OLED for displaying an image, accordingly. Since the second power source voltage ELVSS connected to the cathode of the organic light emitting diode OLED maintains the low-level voltage during the scan period T2, a driving current path is formed toward a cathode terminal of the organic light emitting diode OLED such than an image can be displayed.

The scan period T2 is a data writing period during which a data signal Vdata according to an image data signal is applied to each pixel, and also a light emission period during which an organic light emitting diode of each pixel sequentially displays an image according to the data signal Vdata.

The first transistor M1 driven in a linear area according to a data voltage applied through the corresponding data line during the period T2 can only be driven in the saturation area due to the third transistor M3 applied with the bias voltage during the compensation period in advance before the scan period.

Figure 4:
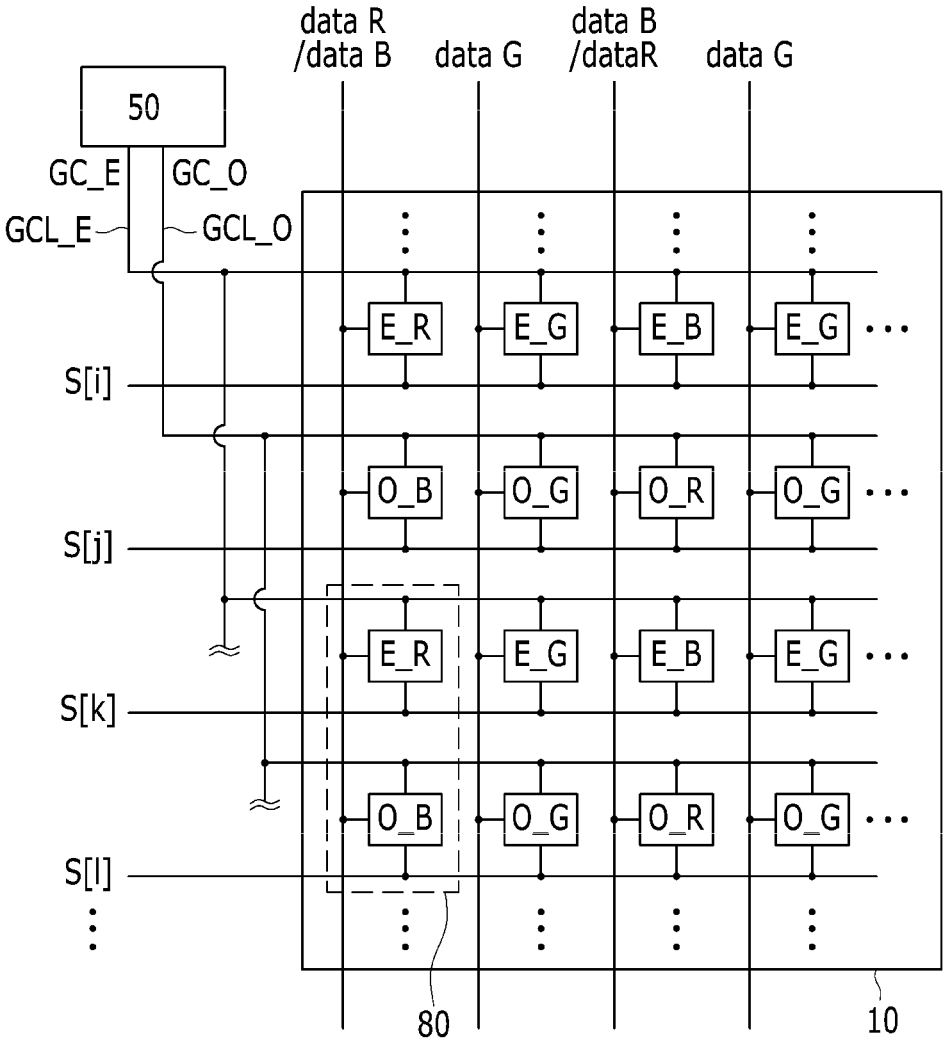
FIG. 4 shows a display panel having a pixel alignment structure according to another exemplary embodiment of the present invention and a compensation signal unit of the display device of FIG. 1.

FIG. 4 shows a display panel having a pixel alignment structure and a compensation signal unit in the display device of FIG. 1 according to another exemplary embodiment of the present invention.

In particular, referring to FIG. 4, a display panel 10 included in the display device may have a plurality of pixels having a PenTile alignment structure according to a light emission color of an organic light emitting diode of each pixel. That is, the plurality of pixels have a PenTile alignment structure in which the organic light emitting diode of each pixel iteratively emits light with a unit of red, green, blue, and green (RGBG).

A driving method according to the exemplary embodiment of FIG. 4 divides the display panel having pixels aligned with the PenTile structure into a predetermined pixel area and dually separates a compensation period.

In further detail, the plurality of pixels of the display panel 10 included in the display panel 10 according to the exemplary embodiment of FIG. 4 is divided into two pixel areas, that is, a first pixel area E and a second pixel area O, and the first pixel area E and the second pixel area O are respectively formed of a plurality of pixel lines, each including a plurality of pixels arranged in a RGBG PenTile structure. In addition, the first pixel area E and the second pixel area O are crossly arranged for each pixel line. For better understanding and ease of description, a plurality of pixels included in the first pixel area are marked as E and a plurality of pixels included in the second pixel area are marked as O in FIG. 4. In addition, a red color, a green color, and a blue color displayed through light emission of organic light emitting diodes of the respective pixels are respectively marked as R, G, and B. The exemplary embodiment of FIG. 4 is one example, and the structure of the pixel area can be variously changed.

According to the exemplary embodiment of FIG. 4, the plurality of pixels included in the display panel are divided into two pixel areas and then driven therein, and thus additional compensation control lines are connected according to the two pixel areas and the plurality of pixels include in the two pixel areas have different compensation periods corresponding to a compensation control signal applied through the additional compensation control line.

FIG. 4 exemplarily illustrates a plurality of pixels corresponding to four pixel columns among from the i-th pixel line to the 1-th pixel line among the plurality of pixel lines included in the display panel 10. Pixels corresponding to the four pixel columns are commonly connected to the corresponding data lines and receive data signals for displaying an image corresponding to a light emission color of the corresponding pixel through the data lines. In FIG. 4, pixels displaying RGBG colors or BGRG colors are arranged along an alignment direction of pixel columns in each pixel line.

In addition, the compensation signal unit 50 is connected to the display panel 10 and a plurality of compensation control lines, and the plurality of compensation control lines include a first compensation control line GCL_E and a second compensation control line GCL_O.

The first compensation control line GCL_E is connected to the compensation signal unit 50 and the plurality of pixels included in the first pixel area E of the display panel 10. In further detail, the first compensation control line GCL_E is connected to a gate electrode of the fourth transistor (M4) of each of the plurality of pixels included in the first pixel area E to simultaneously transmit the first compensation control signal GC_E to the plurality of pixels included in the first pixel area E.

In addition, the second compensation control line GCL_O is connected to the compensation signal unit 50 and the plurality of pixels include in the second pixel area O of the display panel 10. In further detail, the second compensation control line GCL_O is connected to a gate electrode of the fourth transistor (M4) of each of the plurality of pixels included in the second pixel area O to simultaneously transmit the second compensation control signal GC_O to the plurality of pixels included in the second pixel area O.

After the first compensation control signal GC_E and the second compensation control signal GC_O are transmitted to the plurality of pixels for each pixel area in the display panel, the sequentially corresponding scan signals S[i] to S[1] are respectively transmitted to the plurality of pixels of the i-th pixel line to the 1-th pixel line through the i-th scan line to the 1-th scan line. Then, each of the plurality of pixels included in the i-th pixel line to the 1-th pixel line are sequentially activated and receive image data signals dataR, dataB, and dataG that respectively displays colors of red, blue, and green through the corresponding data line connected to each pixel column for image displaying. FIG. 4 illustrates RGBG PenTile-type pixel alignment according to the exemplary embodiment, and therefore the plurality of data lines connected to the display panel transmits an image data signal dataR of a red color R, an image data signal dataB of a blue color B, or an image data signal dataG of a green color G according to the first pixel area E or the second pixel area O. However, the present invention is not limited thereto, and a configuration of compensation control lines and data lines transmitting image data signals can be variously changed according to various exemplary embodiments of pixel alignment structures and pixel areas.

Figure 5:
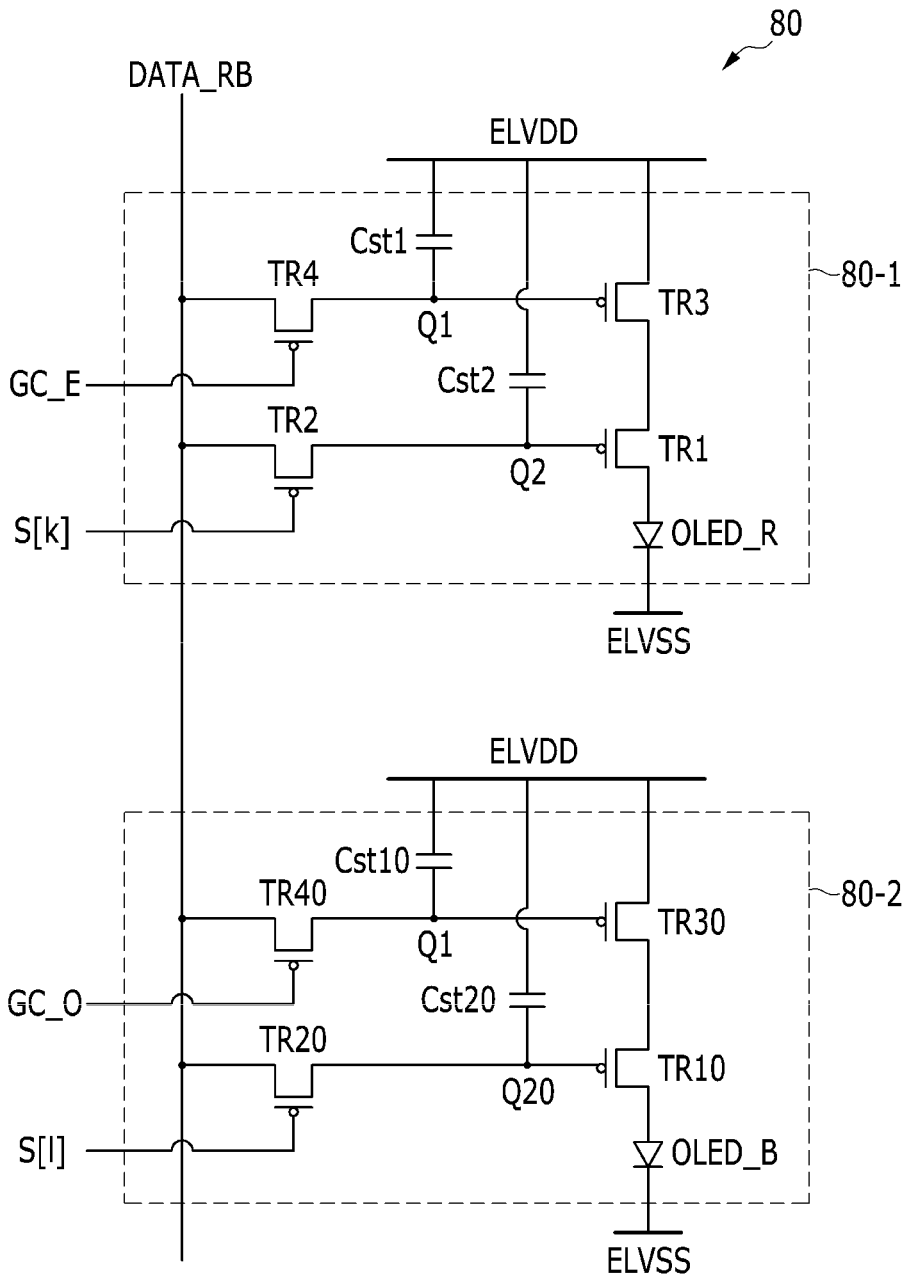
FIG. 5 is a circuit diagram of a partial pixel in the display panel according to the exemplary embodiment of FIG. 4.

FIG. 5 is a detailed structure of a pixel corresponding to a partial area 80 of the display panel of FIG. 4. Particularly, the area 80 corresponds to the first pixel column in the k-th pixel line and the 1-th pixel line in the display panel according to the exemplary embodiment of FIG. 4, and the area 80 includes two pixels E_R and O_B of the first and second pixel areas E and O. The two pixels E_R and O_B respectively have light emitting elements of a red color, light emitting elements of a blue color and receive the corresponding red image data signal dataR or the corresponding blue image data signal dataB among a plurality of image data signals of the corresponding frame through the corresponding data lines extended the first pixel column.

Referring to the circuit structure of the area 80 illustrated in FIG. 5, a pixel (the upper pixel of FIG. 5) corresponding to the first pixel area E includes four transistors TR1, TR2, TR3, and TR4, two capacitors Cst1 and Cst2, and an organic light emitting diode OLED_R emitting light of a red color. In addition, a pixel (the lower pixel of FIG. 5) corresponding to the second pixel area O includes transistors TR10, TR20, TR30, and TR40, two capacitors Cst10 and Cst20, and an organic light emitting diode OLED_B emitting light of a blue color. Elements and a driving operation of the pixels illustrated in FIG. 5 are the same as those described with reference to FIG. 2, and therefore not further description will be provided.

However, a first compensation control signal GC_E corresponding to the first pixel area E is transmitted to a gate electrode of the fourth transistor TR4 of the pixel corresponding to the first pixel area E, and a second compensation control signal GC_O corresponding to the second pixel area O is transmitted to a gate electrode of the fourth transistor TR40 of the pixel corresponding to the second pixel area O.

The first compensation control signal GC_E and the second compensation control signal GC_O are applied with low-level pulse voltages during different periods respectively and thus compensation periods for applying a bias voltage in the pixels respectively included in the first pixel area and the second pixel area may be set to be different from each other.

That is, the fourth transistor TR4 of the corresponding pixel in the first pixel area E is turned on and applies a bias voltage corresponding to white luminance to a gate electrode of the third transistor TR3 corresponding to the first compensation control signal GC_E so that the third transistor TR3 can be operated in the saturation area. In addition, the fourth transistor TR40 of the pixel corresponding to the second pixel area O is turned on corresponding to the second compensation control signal GC_O transmitted at a time point that is different from a driving control time point of the first compensation control signal GC_E and thus applies a bias voltage to a gate electrode of the third transistor TR30.

During different compensation periods, a bias voltage for driving in the saturation area is simultaneously applied to the plurality of pixels included in the first pixel area E, and a bias voltage for driving in the saturation area is simultaneously applied to the plurality of pixels included in the second pixel area O. Then, the pixels are sequentially activated corresponding to scan signals (S[k] and S[1] in FIG. 5) sequentially transmitted to each pixel line and then receive data voltages according to image data signals of the corresponding frame through the corresponding data lines to emit light with the corresponding current for image displaying.

Figure 6:
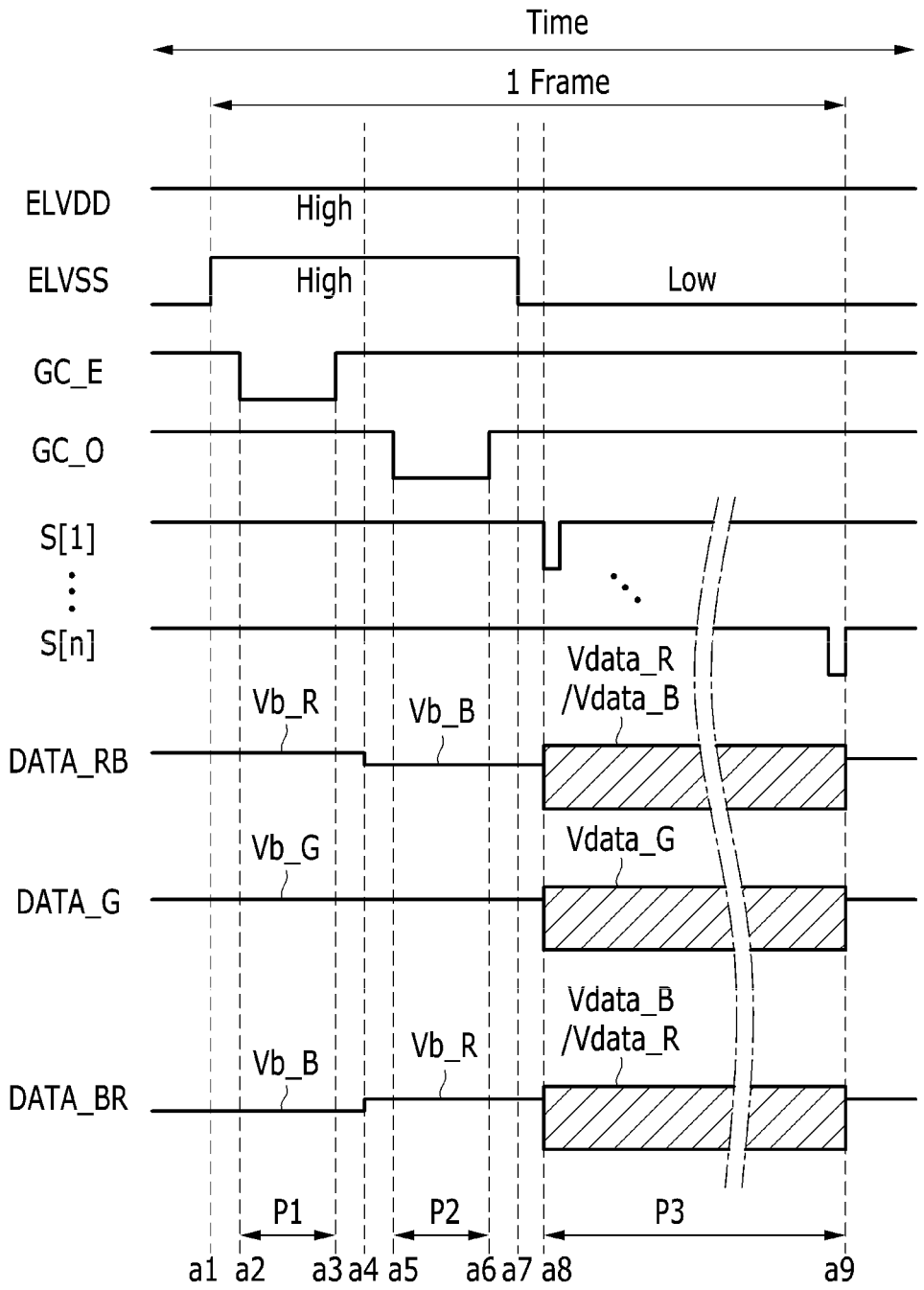
FIG. 6 is a timing diagram of a driving waveform of the pixel of FIG. 5.

In further detail, a timing diagram of the FIG. 6 illustrates the driving waveform of the pixels in FIG. 5.

The timing diagram of FIG. 6 illustrates the first power source voltage ELVDD, the second power source voltage ELVSS, the first compensation control signal GC_E, the second compensation control signal GC_O, the corresponding scan signals (not shown) among the plurality of scan signals S[1] to S[n], and data voltages according to a predetermined bias voltage transmitted through the plurality of data lines extended to the pixel columns according to the PenTile pixel alignment and thus connected to the respective pixels or the image data signals according to RGB light emitting colors, and they are transmitted to the pixels of the first pixel area and the second pixel area included in the area 80. In particular, a voltage applied through a data line connected to a pixel column in which a red color pixel and a blue color pixels area iteratively arranged per line according to cross alignment of the first pixel area or the second pixel area is denoted as DATA_RB, and a voltage applied through a data line connected to a pixel column in which a green color pixel is arranged per line in the cross alignment of the first pixel area or the second pixel area is denoted as DATA_G. In addition, a voltage applied through a data line connected to a pixel column in which a green color pixel and a red color pixel are iteratively arranged per line according to the cross alignment of the first pixel area or the second pixel area is denoted as DATA_BR. Referring to the circuit structure of the area 80 in FIG. 5, a pixel 80-1 of the first pixel area and a pixel 80-2 of the second pixel area respectively arranged up and down in one pixel column are a red color pixel and a blue color pixel, respectively, and therefore a voltage applied through a data line connected to the pixels corresponds to DATA_RB.

The driving process of FIG. 6 will be described with reference to the circuit of FIG. 5.

First, the second power source voltage ELVSS is changed to a high-level voltage at a time a1. The second power source voltage ELVSS maintains the high level until a time a7. Meanwhile, during one frame, the first power source voltage ELVDD is fixed to a predetermined high-level voltage.

Thus, a potential of a cathode of the organic light emitting diode OLED is increased due to the second power source voltage ELVSS applied with high-level during a period from the time a1 to the time a7 so that no current path is formed toward a terminal of the second power source voltage ELVSS.

Next, the first compensation control signal GC_E is changed to a low-level pulse voltage at a time a2 and then applied with the low-level pulse to the fourth transistor TR4 of the pixel included in the first pixel area until a time a3. A period from the time a2 to the time a3 is a first compensation period P1, and the fourth transistor TR4 of the pixel 80-1 of the first pixel area, received the low-level first compensation control signal GC_E during the first compensation period P1 is turned on and a voltage DATA_RB applied through the corresponding data line receives a predetermined bias voltage Vb_R.

Since the pixel 80-1 included in the first pixel area emits light of a red color during the first compensation period P1, the pixel receives the bias voltage Vb_R corresponding to the maximum luminance (i.e., white luminance) of the image data signal of red color through the corresponding data line.

Meanwhile, when a pixel alignment is formed of green pixels only or formed by iteratively arranging blue pixels and red pixels, a predetermined bias voltage is transmitted through the first compensation control signal GC_E through the corresponding data line through the first compensation period P1.

That is, the voltage DATA_G applied through the data line connected to the pixel column of only green pixels is a bias voltage Vb_G corresponding to the maximum white luminance of the image data signal of green color.

In addition, during the same period, a voltage DATA_BR applied through the data line connected to the pixel column where the blue pixels and the red pixels are alternately arranged is a bias voltage Vb_B corresponding to the maximum white luminance of an image data signal of blue color.

Since a white luminance voltage corresponding to a light emission color of the corresponding pixel is applied as a bias voltage to the gate electrode of the third transistors of the entire pixels included in the first pixel area E during the first compensation P1 so that the pixels can be operated in the saturation area.

Next, the second compensation control signal GC_O is changed to a low-level pulse signal at a time a5 and applied as a low-level pulse to the fourth transistor TR40 of the pixels included in the second pixel area until a time a6. A period from the time a5 to the time a6 is a second compensation period P2, and the fourth transistor TR40 of the pixel 80-2 in the second pixel area, received the low-level second compensation control signal GC_O is turned on during the second compensation period P2 so that a voltage DATA_RB applied through the corresponding data line receives the predetermined bias voltage Vb_B.

Since the pixelm80-2 included in the second pixel area emits light of blue color during the second compensation period P2, the pixel 80-2 receives the bias voltage Vb_B corresponding to the maximum luminance (i.e., white luminance) of an image data signal of blue color through the corresponding data line.

Meanwhile, a voltage DATA_G applied through a data line connected to the pixel column of only the green pixels is a bias voltage Vb_G corresponding to the maximum white luminance of the image data signal of green color during the second compensation period P2.

In addition, during the same period, a voltage DATA_BR applied through the data line connected to the pixel column where the blue pixels and the red pixels are alternately arranged is a bias voltage Vb_R that corresponds to the maximum white luminance of an image data signal of red color.

Thus, a white luminance voltage corresponding to light emission color of the corresponding pixel is applied as the bias voltage to the gate electrode of the third transistors of the entire pixels included in the second pixel area O and thus the pixels can be operated in the saturation area during the second compensation period P2.

After the first compensation period P1 and the second compensation period P2 are passed, the first scan signal S[1] begins to be transmitted as a low-level pulse through the first scan line connected to the first pixel line at a time a8. Thus, the plurality of scan signals S[1] to S[n] are sequentially applied as the low-level pulse through the plurality of scan lines connected along the pixel line until reaching a time a9.

A period from the time a8 to the time a9 is a scan period P3, the second transistors of the respective pixels received the corresponding scan signals among the plurality of pixels included in the display panel 10 are sequentially turned on during the scan period P3. That is, in the pixel circuit of FIG. 5, the second transistor TR2 of the pixel 80-1 of the first pixel area is turned on in response to the k-th scan signal S[k] and then the pixel 80-1 receives a data voltage Vdata_R according to an image data signal of red color of the corresponding frame through the corresponding data line and transmits the data voltage Vdata_R to a second node Q2.

Since a gate electrode and a storage capacitor Cst2 of the first transistor TR1 are connected to the second node Q2, the storage capacitor Cst2 stores and maintains the voltage Vdata_R corresponding to the image data signal of red color of each frame during a given period. In addition, the first transistor TR1 generates a driving current according to the data voltage applied to the gate electrode thereof and transmits the driving current to an organic light emitting diode OLED_R for corresponding image display.

Meanwhile, when the 1-th scan signal S[1] among the plurality of sequentially transmitted scan signals is applied with low-level as shown in the circuit of FIG. 5, the second transistor TR20 of the pixel 80-2 of the second pixel area is turned on in response to the scan signal S[1], and then the second transistor TR20 receives the data voltage Vdata_B according to an image data signal of blue color of the corresponding frame through the corresponding data line and transmits the data voltage Vdata_B to the second node Q20. Since a gate electrode and a storage capacitor Cst20 of the first transistor TR10 are connected to the second node Q20, the storage capacitor Cst20 stores and maintains the voltage Vdata_B corresponding to the image data signal of blue color of each frame during a given period. In addition, the first transistor TR10 generates a driving current according to the data voltage applied to the gate electrode thereof and transmits the driving current to an organic light emitting diode OLED_B for corresponding image display. Since the second power source voltage ELVSS connected to the cathode of the organic light emitting diode maintains a low-level during the scan period P3, a driving current path is formed toward the cathode of the organic light emitting diode so that an image can be displayed.

The compensation period of each pixel area is set to be different from each other while driving the pixel with the digital method, and the maximum white luminance voltage of a color data signal of the corresponding light emitting element is applied as a bias voltage to the compensation transistor connected to the driving transistor of the pixel in each pixel area during the different compensation period so that the driving transistor can be driven in the saturation area. Then, the display device does not sensitively react to characteristic deterioration of the organic light emitting diode, and luminance deviation in image display can be reduced.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims. Therefore, those skilled in the art can understand that various modifications and other equivalent exemplary embodiment may be made therefrom. Those skilled in the art can omit some of the constituent elements described in the present specification without deterioration in performance thereof or can add constituent elements to improve performance thereof. Furthermore, those skilled in the art can modify the sequence of the steps of the method described in the present specification depending on the process environment or equipment. Accordingly, the true technical protection scope of the present invention must be determined by the technical spirit of the accompanying claims.

What is claimed is:

1. A display device comprising:

a data driver transmitting a plurality of data signals and a predetermined bias voltage;

a scan driver generating and transmitting a plurality of scan signals;

a display panel including a plurality of pixels, each emitting light with a driving current according to the plurality of data signals;

a compensation signal unit generating and transmitting a compensation control signal for controlling simultaneous transmission of the predetermined bias voltage to each of the plurality of pixels before a data voltage according to the plurality of data signals is applied to each of the plurality of pixels;

a power controller controlling voltage levels of a first power source voltage and a second power source voltage and supplying the level-controlled first and second power source voltages; and a timing controller generating the plurality of data signals by processing an external image signal and generating a plurality of driving control signals that respectively control driving of the data driver, the scan driver, the compensation signal unit, and the power controller, each of the plurality of pixels including a first capacitor and a second capacitor, wherein the first capacitor stores the predetermined bias voltage and the second capacitor stores the data voltage.

2. The display device of claim 1, wherein the predetermined bias voltage is set as a white voltage that displays the maximum luminance along the plurality of data signals.

3. The display device of claim 1, wherein the display panel is formed of a first pixel area including a plurality of first pixels among the plurality of pixels and a second pixel area including a plurality of second pixels that are the rest of the pixels, excluding the first pixels from the plurality of pixels, the compensation signal unit is connected to a first compensation control line connected to the plurality of first pixels included in the first pixel area and a second compensation control line connected to the plurality of second pixels included in the second pixel area, and the compensation signal unit generates and transmits a first compensation control signal and a second compensation control signal, controlling application of the bias voltage, respectively through the first compensation control line and the second compensation control line.

4. The display device of claim 3, wherein the plurality of first pixels included in the first pixel area and the plurality of second pixels included in the second pixel area respectively are iteratively aligned by a unit of a first color pixel, a second color pixel, a third color pixel, and the second color pixel.

5. The display device of claim 3, wherein the compensation signal unit transmits the first compensation control signal and the second compensation control signal before a plurality of data signals are transmitted to the plurality of pixels included in the display panel.

6. The display device of claim 1, wherein the bias voltage is applied to each of the plurality of pixels through the plurality of data lines connected between the data driver and each of the plurality of pixels.

7. The display device of claim 6, wherein each of the plurality of pixels comprises a switching element of which switching operation is controlled by the compensation control signal, and the bias voltage is applied to the turn-on switching element responding to the compensation control signal.

8. The display device of claim 1, wherein each of the plurality of pixels receives the bias voltage through a source electrode of a driving transistor thereof according to the compensation control signal.

9. The display device of claim 1, wherein the power controller supplies the first power source voltage as a predetermined high-level voltage during one frame, and supplies the second power source voltage as a predetermined high-level voltage for a compensation period during which the compensation control signal is transmitted in one frame.

10. The display device of claim 1, wherein each of the plurality of pixels comprises:

an organic light emitting diode;

a first transistor electrically connected to a supply line of the first power source voltage and supplying a driving current to the organic light emitting diode;

a second transistor connected to the corresponding data line among the plurality of data lines transmitting the plurality of data signals to transmit a data voltage according to the plurality of data signals of one frame to a gate electrode of the first transistor;

a third transistor connected between the first power source voltage supply line and the first transistor to receive the bias voltage for a compensation period during which the compensation control signal is transmitted in the frame; and a fourth transistor connected to the corresponding data line to transmit the bias voltage to a gate electrode of the third transistor through the data line corresponding to the compensation control signal during the compensation period in the frame;

the first capacitor being connected to the gate electrode of the third transistor, and the second capacitor being connected to the gate electrode of the first transistor.

11. The display device of claim 10, wherein each of the plurality of pixels comprises a plurality of pixels included in a first pixel area and a plurality of second pixels included in a second pixel area, a gate electrode of the fourth transistor of the first pixel receives a first compensation control signal during a first compensation period in the compensation period, and, a gate electrode of the fourth transistor of the second pixel receives a second compensation control signal during a second compensation period after the first compensation period in the compensation period.

12. A pixel comprising:

an organic light emitting diode;

a driving transistor electrically connected to a first power source voltage supply line and supplying a driving current to the organic light emitting diode;

a switching transistor connected to the corresponding scan line among a plurality of scan lines transmitting a plurality of scan signals to transmit a data voltage according to the corresponding data signal among a plurality of data signal to a gate electrode of the driving transistor according to the corresponding scan signal;

a compensation transistor connected between the first power source voltage supply line and the driving transistor to receive a predetermined bias voltage during a compensation period in one frame;

a control transistor connected to a data line transmitting the data voltage to transmit the bias voltage to a gate electrode of the compensation transistor through the data line in response to a compensation control signal during the compensation period;

a compensation capacitor connected to the gate electrode of the compensation transistor; and a storage capacitor connected to the gate electrode of the driving transistor.

13. The pixel of claim 12, wherein the control transistor comprises a gate electrode receiving the compensation control signal, a source electrode connected to the data line to receive the bias voltage during the compensation period, and a drain electrode connected to the gate electrode of the compensation transistor.

14. The pixel of claim 13, wherein the control transistors included in the respective pixel areas receive compensation control signals respectively transmitted during different periods in the compensation period through compensation control lines connected with gate electrodes thereof.

15. The pixel of claim 12, wherein the predetermined bias voltage is set to a white voltage that displays maximum luminance among the plurality of data signals.

16. The pixel of claim 12, wherein the first power source voltage is applied as a predetermined high-level voltage during the frame, and the second power source voltage is applied as a predetermined high-level voltage during the compensation period in the frame.

17. A method for driving a display device including a plurality of pixels, each including an organic light emitting diode, a driving transistor connected to a first power source voltage supply line to supply a driving current to the organic light emitting diode, a compensation transistor provided between the first power source voltage supply line and the driving transistor to receive a predetermined bias voltage for the driving transistor to be operated in a saturation area, a compensation capacitor connected to a gate electrode of the compensation transistor, and a storage capacitor connected to a gate electrode of the driving transistor, comprising:

a compensation step for simultaneously storing the bias voltage in the compensation capacitor of the respective pixels;

a scanning and data writing step for the plurality of pixels to sequentially store data voltages according to the corresponding data signals among a plurality of data signals of one frame for each pixel line to the storage capacitors thereof in response to the corresponding scan signals among a plurality of scan signals of the frame; and a light emission step during which the organic light emitting diode emits light according to the driving current corresponding to the data voltage applied to the gate electrode of the driving transistor.

18. The method for driving the display device of claim 17, wherein the predetermined bias voltage is set to a white voltage that displays the maximum luminance along the plurality of data signals.

19. The method for driving the display device of claim 17, wherein each of the plurality of pixels comprises a plurality of first pixels included in a first pixel area and a plurality of second pixels included in a second pixel area, and the compensation step includes a first compensation step for simultaneously storing the bias voltage to compensation capacitors of the plurality of first pixels and a second compensation step for simultaneously storing the bias voltage in compensation capacitors of the plurality of second pixels.

20. The method for driving the display device of claim 19, wherein each of the plurality of first pixels and each of the plurality of second pixels further comprise control transistors of which lateral electrodes are connected between the corresponding data line among a plurality of data lines transmitting a plurality of data signals and the compensation capacitor, a first compensation control signal is applied to a gate electrode of a control transistor of each of the plurality of first pixels in the first compensation step, a second compensation control signal is applied to a gate electrode of a control transistor of each of the plurality of second pixels in the second compensation control step, and the control transistor of each of the plurality of first and second pixels transmits the bias voltage to the compensation capacitor corresponding to the first compensation control signal and the second compensation control signal.

21. The method for driving the display device of claim 17, wherein each of the plurality of pixels further comprises a control transistor of which lateral electrodes are connected between the corresponding data line transmitting a plurality of data signals and the compensation capacitor, a compensation control signal is applied to a gate electrode of a control transistor of each of the plurality of pixels in the compensation step, and the control transistor of each of the plurality of pixels transmits the bias voltage to the compensation capacitor responding to the compensation control signal.

22. The method for driving the display device of claim 17, wherein the first power source voltage is supplied as a predetermined high-level voltage during the frame, and a second power source voltage applied to a cathode of the organic light emitting diode is supplied as a predetermined high-level voltage during the compensation step.

* * * * *